US011739748B2

(12) United States Patent
Hurst et al.

(10) Patent No.: US 11,739,748 B2
(45) Date of Patent: Aug. 29, 2023

(54) PUMP FLUID END WITH EASY ACCESS SUCTION VALVE

(71) Applicant: Halliburton Energy Services, Inc., Houston, TX (US)

(72) Inventors: Justin Lee Hurst, Healdton, OK (US); James Alan Olis, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 97 days.

(21) Appl. No.: 16/411,891

(22) Filed: May 14, 2019

(65) Prior Publication Data

US 2020/0362853 A1 Nov. 19, 2020

(51) Int. Cl.

| | |
|---|---|
| ***F04B 53/10*** | (2006.01) |
| ***F04B 1/0461*** | (2020.01) |
| ***F04B 53/22*** | (2006.01) |
| ***F04B 23/06*** | (2006.01) |
| *F04B 15/02* | (2006.01) |

(52) U.S. Cl.

CPC ..... *F04B 53/1087* (2013.01); *F04B 1/0461* (2013.01); *F04B 23/06* (2013.01); *F04B 53/22* (2013.01); *F04B 15/02* (2013.01)

(58) Field of Classification Search

CPC ..... F04B 53/1087; F04B 53/22; F04B 23/06; F04B 15/02; F04B 53/127; F04B 1/053; F04B 53/102; F04B 1/0461

USPC ..... 417/568, 454

See application file for complete search history.

(56) References Cited

U.S. PATENT DOCUMENTS

| | | | | |
|---|---|---|---|---|
| 1,662,725 A | | 3/1928 | Toney, Jr. | |
| 2,673,519 A | | 3/1954 | Halliburton | |
| 2,678,006 A | | 5/1954 | Gray | |
| 3,005,412 A | | 10/1961 | Camp | |
| 3,175,758 A | * | 3/1965 | Dirk | F04B 27/005 417/415 |
| 3,229,640 A | | 1/1966 | Williams | |
| 3,299,417 A | | 1/1967 | Sibthorpe | |
| 3,301,197 A | | 1/1967 | Dodson et al. | |
| 3,380,247 A | | 4/1968 | Colmerauer | |

(Continued)

FOREIGN PATENT DOCUMENTS

| | | |
|---|---|---|
| CH | 257522 A | 10/1948 |
| DE | 19808724 A1 | 9/1998 |

(Continued)

OTHER PUBLICATIONS

Acknowledgement receipt and specification for patent application entitled, "Easy Change Pump Plunger," by Justin L. Hurst, et al., filed May 14, 2019 as U.S. Appl. No. 16/411,894.

(Continued)

*Primary Examiner* — Charles G Freay
*Assistant Examiner* — Lilya Pekarskaya
(74) *Attorney, Agent, or Firm* — Conley Rose, P.C.; Rodney B. Carroll

(57) ABSTRACT

A pump fluid end comprising a discharge valve assembly comprising a discharge valve seat and a discharge valve body, a suction valve assembly comprising a suction valve seat and a suction valve body, and a reciprocating element, wherein an inside diameter of the discharge valve seat is greater than an outside diameter of the suction valve body, the suction valve seat, the reciprocating element, or a combination thereof.

20 Claims, 7 Drawing Sheets

(56) References Cited

U.S. PATENT DOCUMENTS 3,403,845 A * 10/1968 Marshall ..... F04B 41/02 417/570
3,459,363 A 8/1969 Miller
3,516,434 A 6/1970 Noss
3,664,371 A 5/1972 Schneider
3,679,332 A * 7/1972 Yohpe ..... F04B 1/00 417/570
3,887,305 A 6/1975 Ito
4,341,235 A 7/1982 Nord
4,478,561 A 10/1984 Elliston
4,784,588 A 11/1988 Miyashita et al.
4,850,392 A 7/1989 Crump et al.
4,939,923 A 7/1990 Sharp
5,040,408 A 8/1991 Webb
5,061,159 A 10/1991 Pryor
5,072,622 A 12/1991 Roach et al.
5,176,025 A 1/1993 Butts
5,203,857 A 4/1993 Terwilliger et al.
5,343,738 A 9/1994 Skaggs
5,403,168 A 4/1995 Evenson
5,636,975 A 6/1997 Tiffany et al.
5,720,325 A 2/1998 Grantham
5,924,853 A 7/1999 Pacht
5,947,708 A * 9/1999 Park ..... A61P 9/00 417/570
6,032,699 A 3/2000 Cochran et al.
6,082,392 A 7/2000 Watkins, Jr.
6,164,188 A 12/2000 Miser
6,342,272 B1 1/2002 Halliwell
6,607,010 B1 8/2003 Kashy
6,935,161 B2 8/2005 Hutchinson
7,681,589 B2 * 3/2010 Schwegman ..... F16K 15/18 137/543.13
7,798,165 B2 9/2010 McClung, Jr.
8,234,911 B2 8/2012 Jax
8,360,751 B2 1/2013 Duncan
8,366,408 B2 2/2013 Wago et al.
8,418,363 B2 4/2013 Patel
8,506,262 B2 8/2013 Leugemors et al.
8,550,102 B2 10/2013 Small
8,590,614 B2 11/2013 Surjaatmadja et al.
8,784,081 B1 * 7/2014 Blume ..... F04B 53/162 417/568
8,915,722 B1 * 12/2014 Blume ..... F04B 53/16 417/454
9,499,895 B2 11/2016 Langan et al.
9,528,508 B2 12/2016 Thomeer et al.
9,617,654 B2 4/2017 Rajagopalan et al.
9,732,746 B2 * 8/2017 Chandrasekaran ... F16K 15/026
9,822,894 B2 11/2017 Bayyouk et al.
2004/0037725 A1 * 2/2004 Kim ..... F04B 39/102 417/570
2007/0044848 A1 3/2007 Norman
2007/0267076 A1 11/2007 Strauss et al.
2008/0011057 A1 1/2008 Spaolonzi et al.
2009/0041588 A1 2/2009 Hunter et al.
2009/0041596 A1 2/2009 Ponomarev et al.
2009/0159133 A1 6/2009 Popke et al.
2009/0194174 A1 8/2009 Morgan et al.
2009/0246051 A1 10/2009 Kim
2009/0278069 A1 11/2009 Blanco et al.
2010/0098568 A1 4/2010 Marica
2010/0126250 A1 5/2010 Jax
2010/0158726 A1 * 6/2010 Donald ..... F04B 9/045 417/437
2011/0180740 A1 7/2011 Marica
2011/0189040 A1 8/2011 Vicars
2012/0144995 A1 6/2012 Bayyouk et al.
2012/0148431 A1 6/2012 Gabriel
2012/0223267 A1 9/2012 Marica
2012/0279721 A1 * 11/2012 Surjaatmadja ..... F04B 53/10 166/369
2012/0312402 A1 12/2012 Tyler
2013/0061942 A1 3/2013 Hulsey
2013/0202457 A1 * 8/2013 Bayyouk ..... F04B 53/162 417/279
2013/0319220 A1 12/2013 Lahuraka et al.
2014/0064996 A1 3/2014 Arima
2014/0127036 A1 5/2014 Buckley et al.
2014/0127058 A1 5/2014 Buckley et al.
2014/0127062 A1 5/2014 Buckley et al.
2014/0150889 A1 6/2014 Ragner
2014/0261790 A1 9/2014 Marica
2014/0312257 A1 10/2014 Marica
2014/0322050 A1 10/2014 Marette et al.
2014/0328701 A1 11/2014 Nathan
2014/0348677 A1 11/2014 Moeller et al.
2015/0132157 A1 5/2015 Whaley et al.
2015/0144826 A1 * 5/2015 Bayyouk ..... F04B 53/1087 251/359
2016/0131131 A1 5/2016 Weaver et al.
2016/0131264 A1 5/2016 Bregazzi et al.
2016/0215588 A1 7/2016 Belshan et al.
2016/0281699 A1 9/2016 Gnessin et al.
2016/0319805 A1 11/2016 Dille
2018/0058431 A1 3/2018 Blume
2018/0058444 A1 3/2018 Blume
2018/0298894 A1 * 10/2018 Wagner ..... F04B 53/22
2019/0120389 A1 4/2019 Foster et al.
2019/0145391 A1 5/2019 Davids
2019/0154035 A1 * 5/2019 Cordes ..... F04B 1/0452
2019/0226475 A1 7/2019 Stark et al.
2020/0347706 A1 11/2020 Nowell et al.

FOREIGN PATENT DOCUMENTS

EP 0580196 A1 1/1994
EP 1103722 A2 5/2001
EP 2383470 A1 11/2011
GB 120622 A 11/1918
GB 450645 A 7/1936
GB 672173 A 5/1952
GB 1226014 A 3/1971
GB 1262826 A 2/1972
JP 63001012 Y2 1/1988
JP 2002037217 A 2/2002
JP 2004257283 A 9/2004
JP 4121804 B2 7/2008
JP 2009131747 A 6/2009
JP 5107651 B2 12/2012
JP 2014029148 A 2/2014
JP 2020040010 A 3/2020

OTHER PUBLICATIONS

Acknowledgement receipt and specification for patent application entitled, "Pump Valve Seat with Supplemental Retention," by Justin L. Hurst, et al., filed May 14, 2019 as U.S. Appl. No. 16/411,898.
Acknowledgement receipt and specification for patent application entitled, "Flexible Manifold for Reciprocating Pump," by Joseph A. Beisel, et al., filed May 14, 2019 as U.S. Appl. No. 16/411,901.
Acknowledgement receipt and specification for patent application entitled, "Valve Assembly for a Fluid End with Limited Access," by Justin L. Hurst, et al., filed May 14, 2019 as U.S. Appl. No. 16/411,910.
Acknowledgement receipt and specification for patent application entitled, "Pump Plunger with Wrench Features," by Justin L. Hurst, et al., filed May 14, 2019 as U.S. Appl. No. 16/411,905.
Acknowledgement receipt and specification for patent application entitled, "Pump Fluid End with Positional Indifference for Maintenance," by Justin L. Hurst, et al., filed May 14, 2019 as U.S. Appl. No. 16/411,911.
Filing Receipt and Specification for patent application entitled "Flexible Manifold for Reciprocating Pump," by Joseph A. Beisel, et al., filed Oct. 7, 2019 as U.S. Appl. No. 16/594,825.
Office Action (Restriction Requirement) dated Aug. 28, 2019, (7 pages), U.S. Appl. No. 16/522,874, filed Jul. 26, 2019.
Office Action (Restriction Requirement) dated Aug. 30, 2019, (5 pages), U.S. Appl. No. 16/436,356, filed Jun. 10, 2019.

(56) References Cited

OTHER PUBLICATIONS

Office Action dated Oct. 22, 2019 (27 pages), U.S. Appl. No. 16/522,874, filed Jul. 26, 2019.
Office Action dated Oct. 31, 2019 (21 pages), U.S. Appl. No. 16/436,356, filed Jun. 10, 2019.
Scully Intellicheck2, Complete Overfill Prevention and Retained Product Monitoring System, 67293 Rev B, Oct. 2013, 2 pages.
Scully Intellicheck2, Complete Overfill Prevention and Retained Product Monitoring System, 67293 Rev B, May 2014, 2 pages.
Scully Intellicheck3, Complete Overfill Prevention and Retained Product Monitoring System, XXXXX Rev A, Jun. 2016, 2 pages.
Acknowledgement receipt and specification for patent application entitled "Pump Fluid End with Suction Valve Closure Assist," by Justin L. Hurst, et al., filed Jun. 10, 2019 as U.S. Appl. No. 16/436,312.
Acknowledgement receipt and specification for patent application entitled "Multi-Material Frac Valve Poppet," by Jim B. Surjaatmadja, et al., filed Jun. 10, 2019 as U.S. Appl. No. 16/436,356.
Acknowledgement receipt and specification for patent application entitled "Multi-Layer Coating for Plunger and/or Packing Sleeve," by Justin L. Hurst, et al., filed Jun. 10, 2019 as U.S. Appl. No. 16/436,389.
Acknowledgement receipt and specification for International application entitled "Multi-Layer Coating for Plunger and/or Packing Sleeve," by Justin L. Hurst, et al., filed Jun. 12, 2019 as International application No. PCT/US2019/036785.
Acknowledgement receipt and specification for patent application entitled, "Oil Field Pumps with Reduced Maintenance," by Jim B. Surjaatmadja, et al., filed Jul. 26, 2019 as U.S. Appl. No. 16/522,860.
Acknowledgement receipt and specification for patent application entitled, "Fail Safe Suction Hose for Significantly Moving Suction Port," by Jim B. Surjaatmadja, et al., filed Jul. 26, 2019 as U.S. Appl. No. 16/522,874.
Acknowledgement receipt and specification for International application entitled "Oil Field Pumps with Reduced Maintenance," by Jim B. Surjaatmadja, et al., filed Jul. 30, 2019 as International application No. PCT/US2019/044191.
Acknowledgement receipt and specification for International application entitled "Fail Safe Suction Hose for Significantly Moving Suction Port," by Jim B. Surjaatmadja, et al., filed Jul. 30, 2019 as International application No. PCT/US2019/044194.
Foreign Communication from Related Application—International Search Report and Written Opinion of the International Searching Authority, International Application No. PCT/US2020/016390, dated Jun. 4, 2020, 12 pages.
Foreign Communication from Related Application—International Search Report and Written Opinion of the International Searching Authority, International Application No. PCT/US2020/022043, dated Jul. 3, 2020, 13 pages.
Kiani, Mahdi et al., "Numerical Modeling and Analytical Investigation of Autofrettage Process on the Fluid End Module of Fracture Pumps," Journal of Pressure Vessel Technology, Aug. 2018, pp. 0414031-0414037, vol. 140, ASME.
"Pump Catalog," Cat Pumps, Inc., 2014, 24 pages.
Furuta, Katsunori et al., "Study of the In-Line Pump System for Diesel Engines to Meet Future Emission Regulations," SAE International Congress and Exposition, Feb. 1998, pp. 125-136, Society of Automotive Engineers, Inc.
"550 Series: High Pressure, High Flow Water Jetting," Gardner Denver Water Jetting Systems, Inc., 2009, 4 pages.
Houghton, J.E. et al., "Improved Pump Run Time Using Snow Auto-Rotating Plunger (SARP) Pump," SPE Western Regional Meeting, May 1998, SPE46217, 6 pages, Society of Petroleum Engineers, Inc.
"Improved Double Acting Pump," Scientific American, 1867, pp. 248, vol. 17, No. 16, American Periodicals.
Langewis, Jr., C. et al., "Practical Hydraulics of Positive Displacement Pumps for High-Pressure Waterflood Installations," Journal of Petroleum Technology, Feb. 1971, pp. 173-179, SPE-AIME/Continental Oil Co.
Petzold, Martin et al., "Visualization and Analysis of the Multiphase Flow in an Electromagnetically Driven Dosing Pump," ASME/BATH Symposium on Fluid Power & Motion Control, Oct. 2013, FPMC2013-4433, 6 pages, ASME.
Romer, M. C. et al., "Field Trial of a Novel Self-Reciprocating Hydraulic Pump for Deliquification," SPE Production & Operations, 2017, 12 pages, Society of Petroleum Engineers.

* cited by examiner

PUMP FLUID END WITH EASY ACCESS SUCTION VALVE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present disclosure relates generally to a method and apparatus for supplying pressurized fluids. More particularly, the present disclosure relates to methods and reciprocating devices for pumping fluids into a wellbore.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. One design consideration may concern ease of access to pump fluid end components, as reciprocating pumps used in wellbore operations, for example, often encounter high cyclical pressures and various other conditions that can render pump components susceptible to wear and result in a need for servicing and maintenance of the pump.

Accordingly, it is desirable to provide a pump fluid end that facilitates access to components therein, such as a reciprocating element, components of a suction valve assembly, components of a discharge valve assembly, or a combination thereof.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a reciprocating apparatus for pumping pressurized fluid. In embodiments, the reciprocating apparatus comprises a pump fluid end having a discharge valve assembly and a suction valve assembly, wherein a discharge valve seat of the discharge valve assembly has an inside diameter that is greater than an outside diameter of a suction valve body of the suction valves assembly, an outside diameter of a suction valve seat of the suction valve assembly, an outside diameter of a reciprocating element of the pump, or a combination thereof, such that the suction valve body, the suction valve seat, the reciprocating element, or the combination thereof can pass through the inside diameter of the discharge valve seat of the discharge valve assembly. Such a pump fluid end design facilitates servicing of the pump, for example, by enabling removal of the suction valve body, the suction valve seat, the reciprocating element, or a combination thereof from the pump fluid end through the discharge valve seat of the discharge valve assembly, without requiring removal of the discharge valve seat. In embodiments, the reciprocating apparatus is a high-pressure pump configured to operate at a pressure greater than or equal to about 3,000 psi and/or in a well servicing operation and environment.

Figure 1:
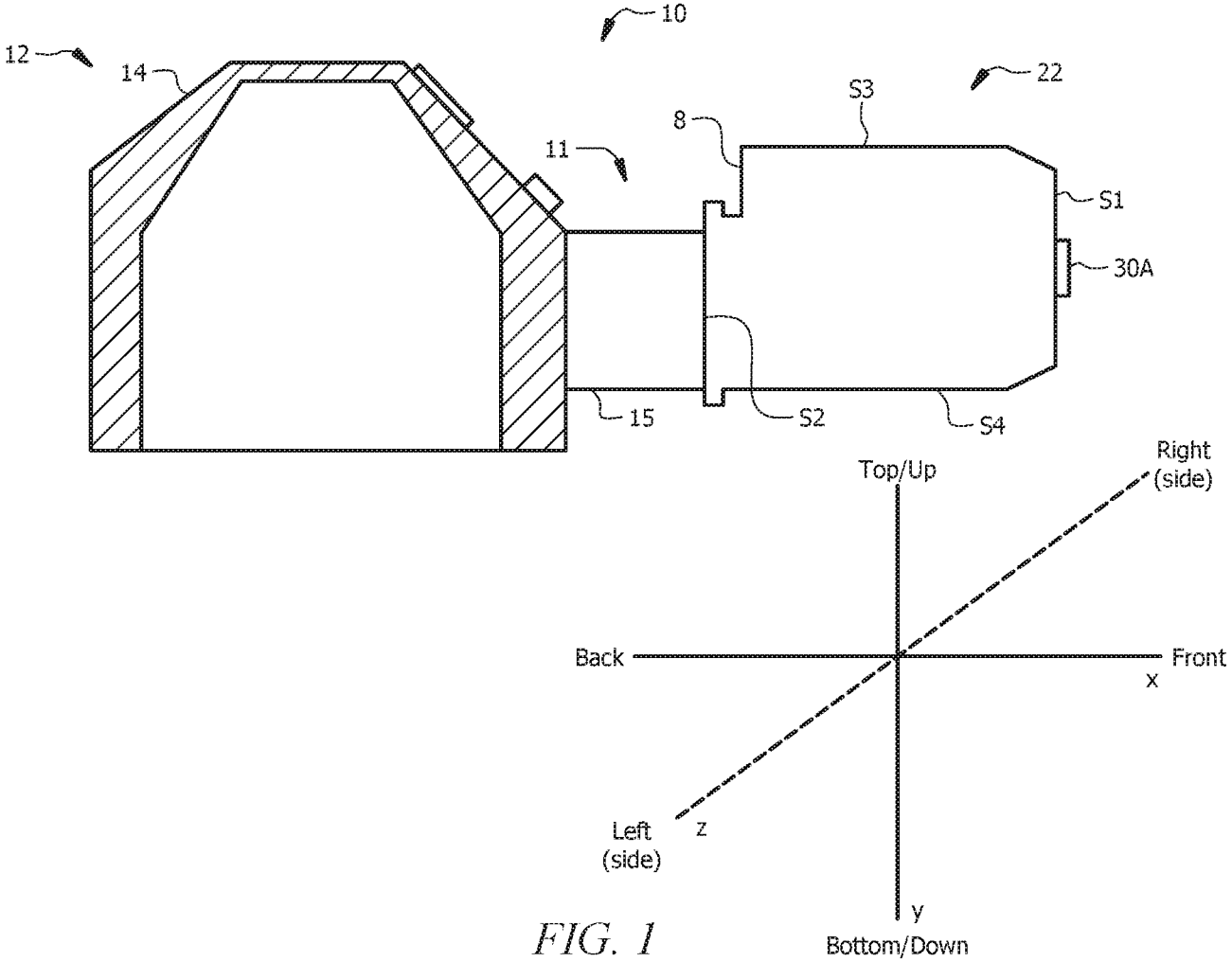
FIG. 1 is an elevational view of a reciprocating pump, according to embodiments of this disclosure.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the x-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2:
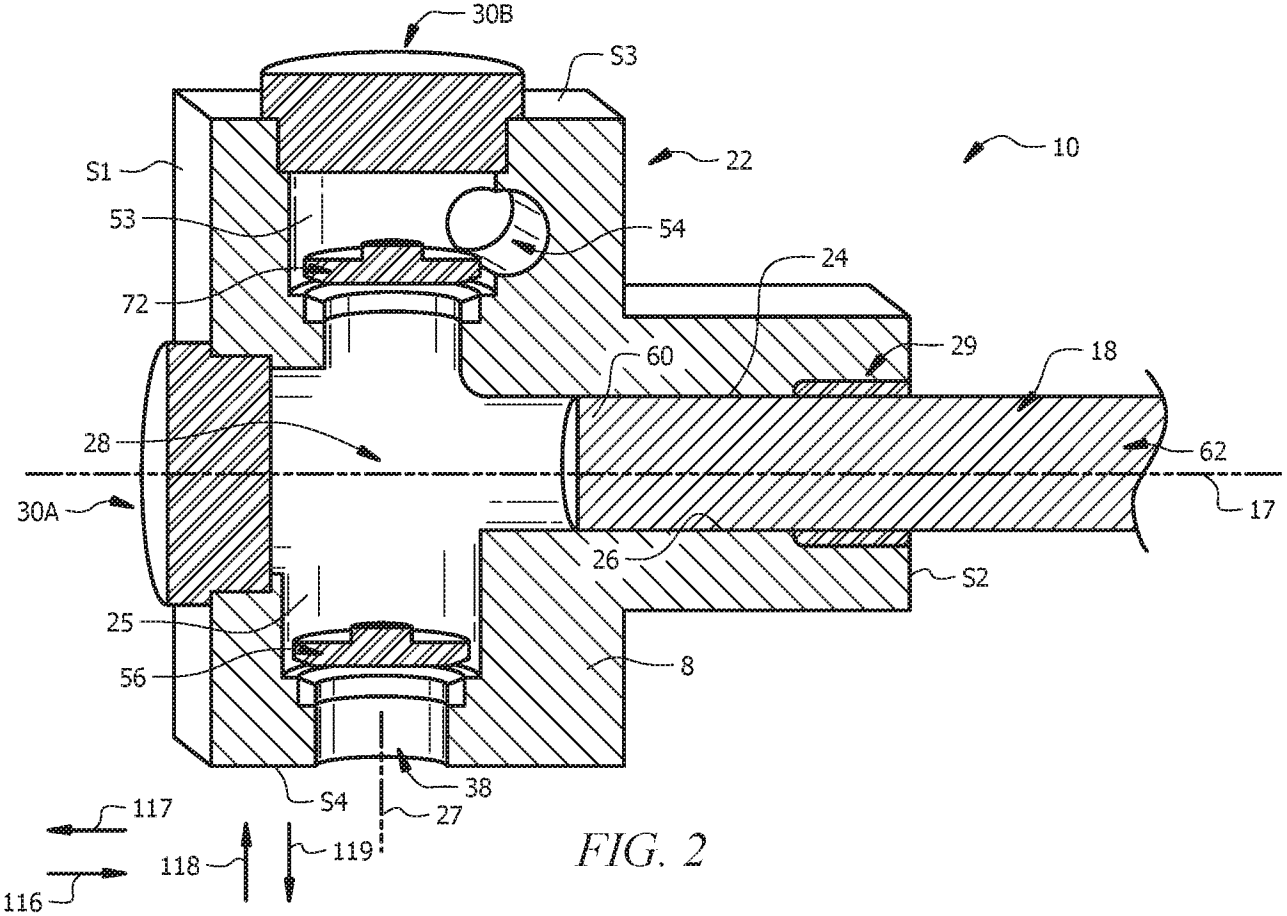
FIG. 2 is a cut-away illustration of an exemplary reciprocating pump comprising a cross-bore pump fluid end, according to embodiments of the present disclosure.
Figure 3:
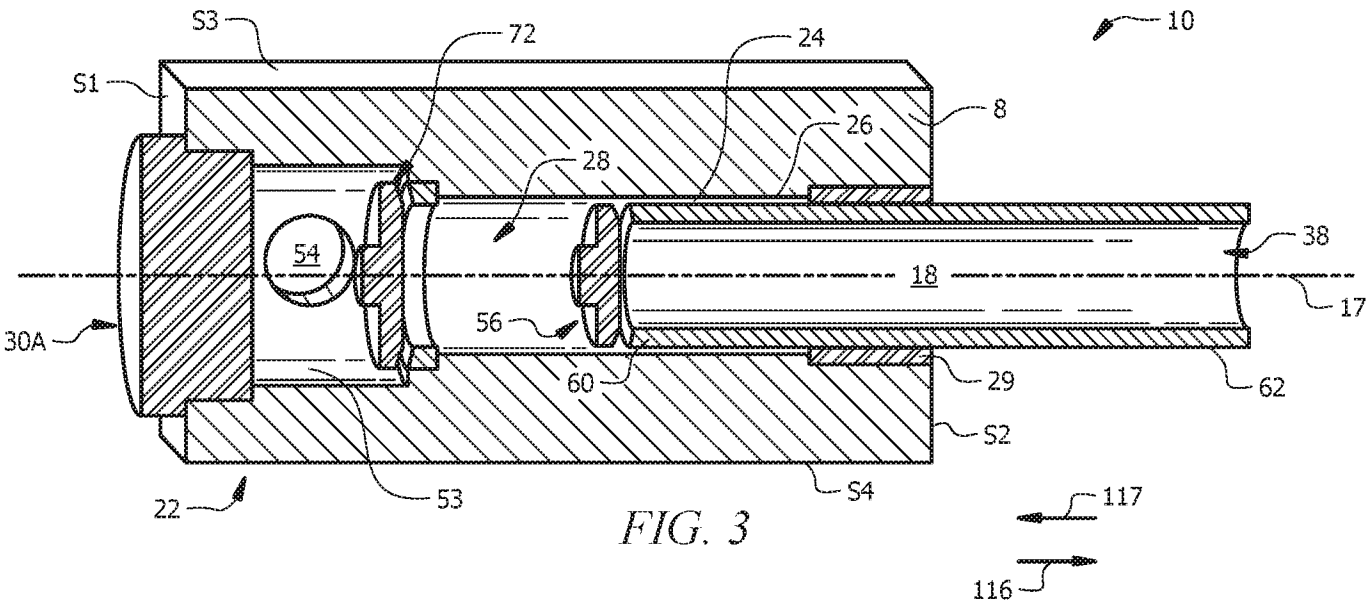
FIG. 3 is a cut-away illustration of an exemplary reciprocating pump comprising a concentric bore pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIGS. 2-3) of the pump fluid end 22. The reciprocating element bore 24 is at least partially defined by a cylinder wall 26. As described further hereinbelow with reference to FIG. 2 and FIG. 3, pump fluid end 22 can be a cross-bore pump fluid end 22 or, alternatively, an in-line or "concentric" bore pump fluid end. As utilized herein, cross-bore pump fluid ends can comprise "T-bore" pump fluid ends, "X-bore" (e.g., cross shaped bore) pump fluid ends, or "Y-bore" pump fluid ends. FIG. 2 is a schematic showing a cross-bore pump fluid end 22 engaged with a reciprocating element 18 and FIG. 3 is a schematic showing a concentric bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 4:
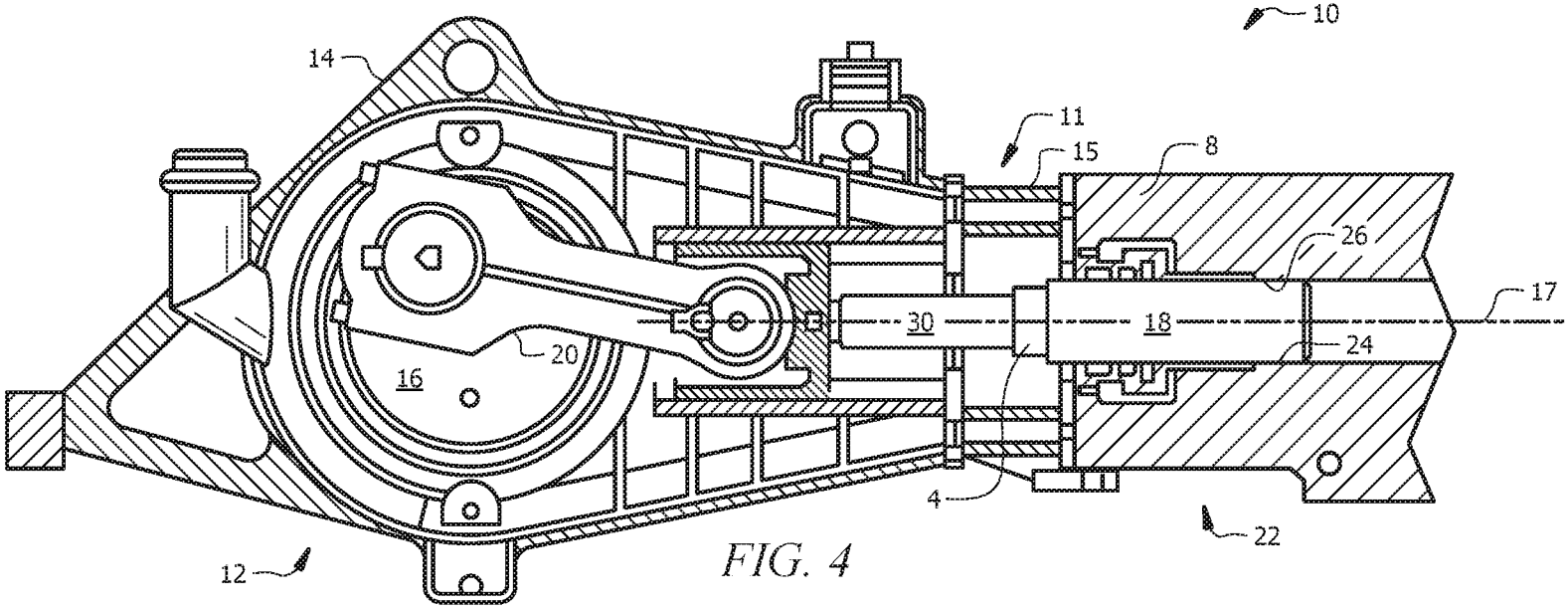
FIG. 4 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 4 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm/connecting rod 20. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm/connecting rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", although not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIGS. 2 and 3. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1) and return strokes (also referred to as suction strokes and correlating to movement in a negative direction parallel to the x-axis of FIG. 1), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. (As utilized here, "high pressure" indicates possible subjection to high pressure during discharge.) When discharge valve assembly 72 is in a closed configuration (e.g., under the influence of a closing mechanism, such as a spring), the high pressure in a discharge pipe or manifold containing discharge outlet 54 prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body and a valve seat thereof) and a configuration in which fluid cannot flow through the valve assembly (e.g., cannot pass between a valve body and a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiment of FIG. 2, which is a schematic showing a cross-bore pump fluid end 22 engaged with a reciprocating element 18, cross-bore pump fluid end 22 comprises a cross-bore fluid end body 8, a cross-bore pump chamber 28, a suction valve assembly 56, and a discharge valve assembly 72. In this cross-bore configuration, suction valve assembly 56 and discharge valve assembly 72 are located in a bore or channel 25 (also referred to herein as a cross bore 25) of pump chamber 28, wherein bore 25 has a central axis 27 that is parallel to the y-axis of FIG. 1 and is perpendicular to bore 24 in which reciprocating element 18 reciprocates during operation. Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 3, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). Suction valve assembly 56 and discharge valve assembly 72 are operable to direct fluid flow within the pump 10. In some concentric bore fluid end designs, fluid flows within a hollow reciprocating element (e.g., a hollow plunger) 18. In some such embodiments, the reciprocating element bore 24 of such a concentric bore fluid end design can be defined by a high pressure cylinder 26 providing a high pressure chamber and a low pressure cylinder (not depicted in the embodiment of FIG. 3) providing a low pressure chamber toward tail end 62 of reciprocating element 18, whereby fluid from fluid inlet 38 enters reciprocating element 18. When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a concentric bore pump fluid end 22 design, the fluid inlet can be configured to introduce fluid into pump chamber 28 via a reciprocating element 18 that is hollow and/or via a low pressure chamber as described above. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. For example, with reference to the cross-bore fluid end body 8 embodiment of FIG. 2, a front access port 30A can be located on a front S1 of the pump fluid end 22 opposite a back S2 of the pump fluid end 22, wherein the back S2 of the pump fluid end is proximal the pump power end 12, upon integration therewith via integration section 11.

A top access port 30B can be located on a top S3 of the pump fluid end 22 opposite a bottom S4 of the pump fluid end 22, wherein the top S1 of the pump fluid end 22 is above central axis 17 and the bottom S4 of the pump fluid end 22 is below central axis 17. With reference to the concentric fluid end body 8 embodiment of FIG. 3, a front access port 30A can be located on a front S1 of the pump fluid end 22 opposite a back S2 of the pump fluid end 22, wherein the back S2 of the pump fluid end is proximal the pump power end 12, upon integration therewith via integration section 11. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port located on a side of the discharge valve assembly 72 opposite the suction valve assembly 56. For example, in the cross-bore pump fluid end 22 embodiment of FIG. 2, top access port 30B is located on a side (e.g., top side) of discharge valve assembly 72 opposite suction valve assembly 56, while in the concentric bore pump fluid end 22 embodiment of FIG. 3, front access port 30A is located on a side (e.g., front side) of discharge valve assembly 72 opposite suction valve assembly 56.

In embodiments, one or more seals 29 (e.g., "o-ring" seals, packing seals, or the like), also referred to herein as 'primary' reciprocating element packing 29 may be arranged around the reciprocating element 18 to provide sealing between the outer walls of the reciprocating element 18 and the inner walls 26 defining at least a portion of the reciprocating element bore 24. In some concentric bore fluid end designs, a second set of seals (also referred to herein as 'secondary' reciprocating element packing; not shown in the Figures) may be fixedly arranged around the reciprocating element 18 to provide sealing between the outer walls of the reciprocating element 18 and the inner walls of a low-pressure cylinder that defines the low pressure chamber described hereinabove (e.g., wherein the secondary packing is farther back along the x-axis and delineates a back end of the low pressure chamber that extends from the primary packing 29 to the secondary packing). Skilled artisans will recognize that the seals may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24. In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages 4 (FIG. 4; e.g., clamps, adapters, extensions, etc.) may be used to couple the reciprocating element 18 to the pump power end 12 (e.g., to a pushrod 30).

In some embodiments (e.g., cross-bore pump fluid end 22 embodiments such as FIG. 2), the reciprocating element may be substantially solid and/or impermeable (e.g., not hollow). In alternative embodiments (e.g., concentric bore pump fluid end 22 embodiment such as FIG. 3), the reciprocating element 18 comprises a peripheral wall defining a hollow body. Additionally (e.g., concentric bore pump fluid end 22 embodiments such as FIG. 3), a portion of the peripheral wall of reciprocating element 18 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end, when assembled, may be substantially solid and/or impermeable (e.g., a plunger having both a hollow portion and a solid portion).

The reciprocating element 18 comprises a front or free end 60. In embodiments comprising concentric bore pump fluid end designs 22 such as shown in FIG. 3, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back or tail end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within the bore 25 below central axis 17 of the pump fluid end 22, in cross-bore pump fluid end 22 designs such as FIG. 2, such that a suction valve body of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration. The suction valve assembly 56 may be disposed within reciprocating element bore 24 and at least partially within reciprocating element 18 in concentric bore pump fluid end 22 designs such as FIG. 3, such that a suction valve body of the suction valve assembly 56 moves away from a suction valve seat within the a suction valve seat housing of reciprocating element 18 when the suction valve assembly 56 is in an open configuration and toward the suction valve seat when the suction valve assembly 56 is in a closed configuration.

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed within the bore 25 proximal the top S3 of the pump fluid end 22, in cross-bore pump fluid end 22 designs such as FIG. 2, such that a discharge valve body of the discharge valve assembly 72 moves toward the discharge chamber 53 when the discharge valve assembly 72 is in an open configuration and away from the discharge chamber 53 when the discharge valve assembly 72 is in a closed configuration. The discharge valve assembly 72 may be disposed proximal the front S1 of bore 24 of the pump fluid end 22 (e.g., at least partially within discharge chamber 53 and/or pump chamber 28) in concentric bore pump fluid end 22 designs such as FIG. 3, such that a discharge valve body of the discharge valve assembly 72 moves toward the discharge chamber 53 when the discharge valve assembly 72 is in an open configuration and away from the discharge chamber 53 when the discharge valve assembly 72 is in a closed configuration. In addition, the discharge valve assembly 72 may be co-axially aligned with the suction valve assembly 56 (e.g., along central axis 17 in concentric bore pump fluid end 22 configurations such as FIG. 3 or along central axis 27 of bore 25 perpendicular to central axis 17 in cross-bore pump fluid end 22 configurations such as FIG. 2), and, in concentric bore pump fluid end 22 configurations such as FIG. 3, the suction valve assembly 56 and the discharge valve assembly 72 may be coaxially aligned with the reciprocating element 18 (e.g., along central axis 17).

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, poppets, etc.) and/or components may be employed suitable means for retaining the components of the suction valve assembly 56 and the components of the discharge valve assembly 72 within the pump fluid end 22 may be employed.

The fluid inlet 38 may be arranged within any suitable portion of the pump fluid end 22 and configured to supply fluid to the pump in any direction and/or angle. Moreover, the pump fluid end 22 may comprise and/or be coupled to any suitable conduit (e.g., pipe, tubing, or the like) through which a fluid source may supply fluid to the fluid inlet 38. The pump 10 may comprise and/or be coupled to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

In embodiments, the pump fluid end 22 may comprise an external manifold (e.g., a suction header) for feeding fluid to the multiple reciprocating assemblies via any suitable inlet (s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms/connecting rods 20, one or more additional components or mechanical linkages 4, pushrods 30, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the multiple reciprocating elements may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIGS. 2 and 3) forward in its cylinder. A top dead center position corresponds to the position of a fully extended reciprocating element at zero velocity, e.g., just prior to a reciprocating element moving backward (i.e., in a direction indicated by arrow 116 in FIGS. 2 and 3) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

According to this disclosure, and as described further hereinbelow, the suction valve assembly 56, the discharge valve assembly 72, the reciprocating element 18, or a combination thereof are configured such that an inside diameter of a discharge valve seat of the discharge valve assembly 72 is greater than an outside diameter of a suction valve body of the suction valve assembly 56, a suction valve seat of the suction valve assembly 56, the reciprocating element 18, or a combination thereof. The discharge valve assembly 72 and the suction valve assembly 56 can be discharge valve assemblies and suction valve assemblies, respectively, as noted hereinabove, and the design thereof need not be particularly limited except to the extent that the components thereof are sized as described hereinbelow and in the claims (i.e., such that an inside diameter of a discharge valve seat of the discharge valve assembly 72 is greater than an outside diameter of a suction valve body of the suction valve assembly 56, a suction valve seat of the suction valve assembly 56, the reciprocating element 18, or a combination thereof). In embodiments, for example as further described hereinbelow with reference to FIG. 5 and FIG. 6, a pump fluid end 22 of a pump 10 of this disclosure further comprise an access port on a side of the discharge valve assembly 72 opposite the suction valve assembly 57, whereby the suction valve body, the suction valve seat, the reciprocating element 18, or a combination thereof can be removed from the pump fluid end 22 of the pump 10 via passage through the discharge valve seat and the access port. In embodiments such as FIGS. 2 and 5, the suction valve assembly 56 and the discharge valve assembly 72 are coaxial. In embodiments, such as FIGS. 3 and 6, the suction valve assembly 56, the discharge valve assembly 72, and the reciprocating element 18 are coaxial.

In embodiments, pump fluid end 22 comprises a packing assembly, such that packing 29, a packing carrier, and a packing screw can be removed from back S2 of pump fluid end 22 when crankshaft 16 is at TDC, as described, for example, in U.S. patent application Ser. No. 16/411,911, filed May 14, 2019 and is entitled "Pump Fluid End with Positional Indifference for Maintenance", the disclosure of which is hereby incorporated herein in its entirety for purposes not contrary to this disclosure.

Figure 5:
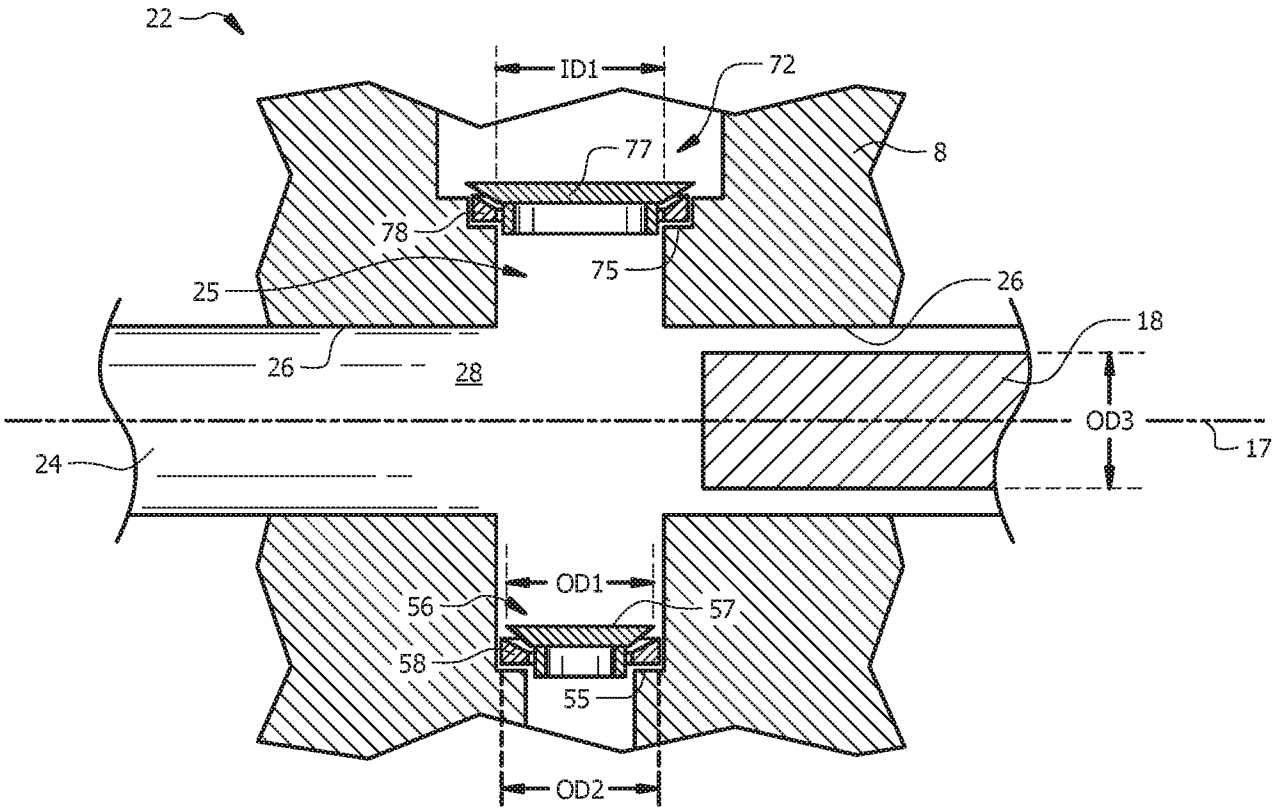
FIG. 5 is a schematic of cross-bore pump fluid end, according to embodiments of the present disclosure.

FIG. 5 provides a schematic of an exemplary cross-bore pump fluid end 22 (e.g., of the type shown in FIG. 2 and described in detail herein) comprising a fluid end body 8 comprising a cross-bore pump chamber 28, a cylindrical reciprocating element bore 24, partially defined by cylinder walls 26, in which a reciprocating element 18 can reciprocate during operation of a pump comprising the pump fluid end 22, the reciprocating element 18, and a pump power end 12 (FIG. 4), and a cylindrical cross-bore 25 comprising a suction valve assembly 56 and a discharge valve assembly 72.

Discharge valve assembly 72 comprises a discharge valve body 77, and a discharge valve seat 78 seated in a discharge valve seat housing 75. In this cross-bore embodiment, discharge valve seat housing 75 is positioned within fluid end body 8 and can comprise a part of an interior surface within cross-bore 25 (e.g, a recess or channel within cross-bore 25 located proximate the top of cross-bore 25). Discharge valve seat 78 has an inside diameter ID1. As utilized herein, discharge valve assembly 72 components include, without limitation, the discharge valve body 77 and the discharge valve seat 78, and can further include an actuating or biasing mechanism (e.g., a discharge valve spring and/or poppet assembly), a deformable seal, or other components known in the art. In embodiments, discharge valve assembly 72 comprises a valve assembly having a valve guide, as described, for example, in U.S. patent application Ser. No. 16/411,910, filed May 14, 2019 and is entitled "Valve Assembly for a Fluid End with Limited Access", the disclosure of which is hereby incorporated herein in its entirety for purposes not contrary to this disclosure.

Suction valve assembly 56 comprises a suction valve body 57 and a suction valve seat 58 seated in a suction valve seat housing 55. In this cross-bore embodiment of FIG. 5, suction valve seat housing 55 is positioned within an interior of fluid end body 8 and can comprise a part of an interior surface within cross-bore 25 on a side of central axis 17 opposite that of discharge valve assembly 72 (e.g., a recess or channel within cross-bore 25 located proximate the bottom of cross-bore 25). For example, in embodiments, such as depicted in FIG. 5, the discharge valve assembly 72 is positioned coaxially above the suction valve assembly 56 within cross-bore 25. Suction valve body 57 has an outside diameter OD1; suction valve seat 58 has an outside diameter OD2, and reciprocating element 18 has an outside diameter OD3. As utilized herein, suction valve assembly 56 components include, without limitation, the suction valve body 57 and the suction valve seat 58, and can further include an actuating or biasing mechanism (e.g., a suction valve spring and/or poppet assembly), a deformable seal, or other components known in the art. In embodiments, suction valve assembly 56 comprises a valve assembly having a valve guide, as described, for example, in U.S. patent application Ser. No. 16/411,910, filed May 14, 2019 and is entitled "Valve Assembly for a Fluid End with Limited Access", the disclosure of which is hereby incorporated herein in its entirety for purposes not contrary to this disclosure.

According to this disclosure, the inside diameter ID1 of the discharge valve seat 78 is greater than the outside diameter OD1 of the suction valve body 57, the outside diameter OD2 of the suction valve seat 58, the outside diameter OD3 of the reciprocating element 18, or a combination thereof. In embodiments of this disclosure comprising cross-bore pump fluid ends, such as shown in the embodiment of FIGS. 2 and 5, the inside diameter ID1 of the discharge valve seat 78 is greater than the outside diameter OD1 of the suction valve body 57. In embodiments of this disclosure comprising cross-bore pump fluid ends 22, such as shown in the embodiment of FIGS. 2 and 5, the inside diameter ID1 of the discharge valve seat 78 is greater than the outside diameter OD2 of the suction valve seat 58. In embodiments of this disclosure comprising cross-bore pump fluid ends 22, such as shown in the embodiment of FIGS. 2 and 5, the inside diameter ID1 of the discharge valve seat 78 is greater than the outside diameter OD1 of the suction valve body 57 and the outside diameter OD2 of the suction valve seat 58.

Due to the utilization of a discharge valve seat 78 having an inside diameter ID1 greater than the outside diameter OD1 of suction valve body 57 or the outside diameter OD2 of suction valve seat 58, the suction valve body 57, the suction valve seat 58, or both the suction valve body 57 and the suction valve seat 58 can pass through the discharge valve seat 78, for example, when a cross-bore pump fluid end 22 of pump 10 is being assembled and/or maintenance is being performed thereon. For example, in embodiments according to this disclosure, a pump fluid end 22 and a pump 10 comprising the pump fluid end 22 further comprises an access port via which the suction valve body 57, the suction valve seat 58, the reciprocating element 18, or a combination thereof can be removed during assembly and/or maintenance. For example, as described herein above with reference to FIG. 2, a cross-bore pump fluid end 22 can comprise an access port 30A (e.g. a front access port) positioned on a front S1 of the pump fluid end 22, an access port 30B (e.g. a top access port) positioned on a top S3 of the pump fluid end 22, or both a front access port 30A and a top access port 30B. Accordingly, design of the discharge valve assembly 72 and the suction valve assembly 56 as described herein enables removal of the suction valve body 57, the suction valve seat 58, or both the suction valve body 57 and the suction valve seat 58 from a cross-bore pump fluid end 22 via passage through the discharge valve seat 78 of the discharge valve assembly 72 and an access port (e.g., top access port 30B) on a side of the discharge valve assembly 72 opposite the suction valve assembly 57. In this manner, the discharge valve seat 78 does not need to be removed from a cross-bore pump fluid end 22 of this disclosure prior to removal of the suction valve body 57 and/or the suction valve seat 58 therefrom.

Figure 6:
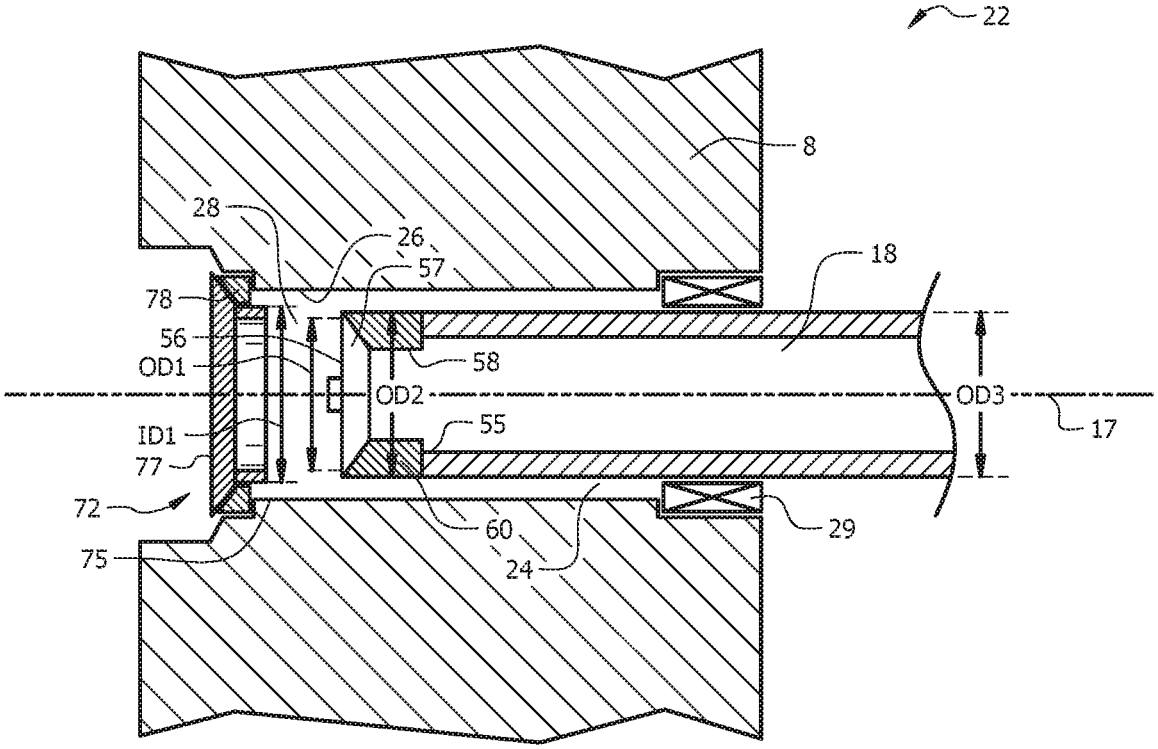
FIG. 6 is a schematic of concentric bore pump fluid end, according to embodiments of the present disclosure.

FIG. 6 provides a schematic of an exemplary concentric bore pump fluid end 22 (e.g., of the type shown in FIG. 3 and described in detail herein) comprising a fluid end body 8 comprising a concentric bore pump chamber 28, a cylindrical reciprocating element bore 24 defined by cylinder wall 26 in which a reciprocating element 18 can reciprocate during operation of a pump 10 comprising the concentric bore pump fluid end 22, the reciprocating element 18, and a pump power end 12 (FIG. 4), and a discharge valve assembly 72 located at one end (e.g., proximate the front end) of reciprocating element bore 24 and a suction valve assembly 56 located at least partially within a front end 60 of reciprocating element 18. In some such concentric bore pump fluid end 22 embodiments, pump 10 comprises a flexible manifold, as described, for example, in U.S. patent application Ser. No. 16/411,901, filed May 14, 2019 and is entitled "Flexible Manifold for Reciprocating Pump", the disclosure of which is hereby incorporated herein in its entirety for purposes not contrary to this disclosure.

As described above with reference to the cross-bore embodiment of FIG. 5, discharge valve assembly 72 comprises a discharge valve body 77, and a discharge valve seat 75 seated in a discharge valve seat housing 75. In this concentric bore embodiment, discharge valve seat housing 75 is positioned within fluid end body 8 and can comprise a part of an interior surface within reciprocating element bore 24 (e.g., a recess or channel within bore 24) located proximate a front side of pump chamber 28 distal the pump power end 12. Discharge valve seat 78 has an inside diameter ID1. In embodiments, discharge valve seat 78 is a valve seat with supplemental retention, as described, for example, in U.S. patent application Ser. No. 16/411,898, filed May 14, 2019 and is entitled "Pump Valve Seat with Supplemental Retention", the disclosure of which is hereby incorporated herein in its entirety for purposes not contrary to this disclosure.

Suction valve assembly 56 comprises a suction valve body 57 and a suction valve seat 58 seated in a suction valve seat housing 55. In this concentric-bore embodiment of FIG. 6, suction valve seat housing 55 is positioned within an interior of and/or can comprise a part of front end 60 of reciprocating element 18. In embodiments, such as depicted in FIG. 6, the suction valve assembly 56 and the discharge valve assembly 72 are positioned coaxially along central axis 17. Again, suction valve body 57 has an outside diameter OD1; suction valve seat 58 has an outside diameter OD2, and reciprocating element 18 has an outside diameter OD3. In embodiments, suction valve seat 58 is a valve seat with supplemental retention, as described, for example, in U.S. patent application Ser. No. 16/411,898, filed May 14, 2019 and is entitled "Pump Valve Seat with Supplemental Retention", the disclosure of which is hereby incorporated herein in its entirety for purposes not contrary to this disclosure.

According to this disclosure, the inside diameter ID1 of the discharge valve seat 78 is greater than the outside diameter OD1 of the suction valve body 57, the outside diameter OD2 of the suction valve seat 58, the outside diameter OD3 of the reciprocating element 18, or a combination thereof. In embodiments of this disclosure comprising concentric-bore pump fluid ends 22, such as shown in the embodiment of FIGS. 3 and 6, the inside diameter ID1 of the discharge valve seat 78 is greater than the outside diameter OD1 of the suction valve body 57. In embodiments of this disclosure comprising concentric bore pump fluid ends 22, such as shown in the embodiment of FIGS. 3 and 6, the inside diameter ID1 of the discharge valve seat 78 is greater than the outside diameter OD2 of the suction valve seat 58. In embodiments of this disclosure comprising concentric bore pump fluid ends 22, such as shown in the embodiment of FIGS. 3 and 6, the inside diameter ID1 of the discharge valve seat 78 is greater than the outside diameter OD1 of the suction valve body 57 and the outside diameter OD2 of the suction valve seat 58. In embodiments of this disclosure comprising concentric bore pump fluid ends 22, such as shown in the embodiment of FIGS. 3 and 6, the inside diameter ID1 of the discharge valve seat 78 is greater than the outside diameter OD3 of the reciprocating element 18. In embodiments of this disclosure comprising concentric bore pump fluid ends 22, such as shown in the embodiment of FIGS. 3 and 6, the inside diameter ID1 of the discharge valve seat 78 is greater than the outside diameter OD1 of the suction valve body 57 and the outside diameter OD3 of the reciprocating element 18. In embodiments of this disclosure comprising concentric bore pump fluid ends 22, such as shown in the embodiment of FIGS. 3 and 6, the inside diameter ID1 of the discharge valve seat 78 is greater than the outside diameter OD2 of the suction valve seat 58 and the outside diameter OD3 of the reciprocating element 18. In embodiments of this disclosure comprising concentric bore pump fluid ends 22, such as shown in the embodiment of FIGS. 3 and 6, the inside diameter ID1 of the discharge valve seat 78 is greater than the outside diameter OD1 of the suction valve body 57, the outside diameter OD2 of the suction valve seat 58 and the outside diameter OD3 of the reciprocating element 18.

Due to the utilization of a discharge valve seat 78 having an inside diameter ID1 greater than the outside diameter OD1 of suction valve body 57, the outside diameter OD2 of suction valve seat 58, the outside diameter OD3 of reciprocating element 18, or a combination thereof, the suction valve body 57, the suction valve seat 58, the reciprocating element 18, or the combination thereof, respectively, can pass through the discharge valve seat 78, for example, when a concentric bore pump fluid end 22 of pump 10 is being assembled and/or maintenance is being performed thereon. For example, in embodiments according to this disclosure, a pump fluid end 22 and a pump 10 comprising the pump fluid end 22 further comprises an access port via which the suction valve body 57, the suction valve seat 58, the reciprocating element 18, or a combination thereof can be removed during assembly and/or maintenance. For example, as described hereinabove with reference to FIG. 3, a concentric bore pump fluid end 22 can comprise an access port 30A (e.g. a front access port) positioned on a front 51 of the pump fluid end 22. Accordingly, design of the discharge valve assembly 72 and the suction valve assembly 56 as described herein enables removal of the suction valve body 57, the suction valve seat 58, the reciprocating element 18, or a combination thereof from a concentric bore pump fluid end 22 via passage through the inside diameter ID1 of the discharge valve seat 78 of the discharge valve assembly 72 and an access port (e.g., front access port 30A) on a side of the discharge valve assembly 72 opposite the suction valve assembly 57. In this manner, the discharge valve seat 78 does not need to be removed from a concentric bore pump fluid end 22 of this disclosure prior to removal of the suction valve body 57, the suction valve seat 58, the reciprocating element 18, or a combination thereof therefrom.

In embodiments, reciprocating element 18 comprises tool engagement features on front 60 thereof, whereby reciprocating element 18 can be removed from pump fluid end 22 by engaging a tool with the engagement features, as described, for example, in U.S. patent application Ser. No. 16/411,905, filed May 14, 2019 and is entitled "Pump Plunger with Wrench Features", the disclosure of which is hereby incorporated herein in its entirety for purposes not contrary to this disclosure.

In embodiments, reciprocating element 18 is coupled with a pushrod 30 of pump power end 12 via a reciprocating element adapter, as described, for example, in U.S. patent application Ser. No. 16/411,894, filed May 14, 2019 and is entitled "Easy Change Pump Plunger", the disclosure of which is hereby incorporated herein in its entirety for purposes not contrary to this disclosure.

Also disclosed herein is a method of servicing a pump 10 of this disclosure. According to this disclosure, a method of servicing a pump of this disclosure comprises opening an access port on the pump fluid end 22 and removing (via passage through the discharge valve seat 78) the suction valve body 57, the suction valve seat 58, the reciprocating element, or a combination thereof from the pump fluid end 22 of the pump 10 via the access port on a side of the discharge valve assembly 72 opposite the suction valve assembly 57. After removing (via passage through the discharge valve seat 78) the suction valve body 57, the suction valve seat 58, the reciprocating element, or the combination thereof from the pump fluid end 22 via the access port, a replacement or repaired suction valve body 57, suction valve seat 58, reciprocating element 18, or combination thereof can be inserted into the pump fluid end 22 via the access port by passing the replacement or repaired suction valve body 57, suction valve seat 58, reciprocating element 18, or the combination thereof through the access port and the discharge valve seat 78. The access port is closed prior to resuming operation of the pump 10.

As noted hereinabove, the access port can be located on a front S1 of the pump 10 or a top S3 of the pump 10. In embodiments, the pump fluid end 22 is a cross-bore pump fluid end, such as depicted in FIG. 2 and FIG. 5, and the access port is a top access port 30B located on the top S3 of the pump fluid end 22. In embodiments, the pump fluid end 22 is a concentric bore pump fluid end, such as depicted in FIG. 3 and FIG. 6, and the access port is a front access port 30A located on the front S1 of the pump fluid end 22.

Figure 7:
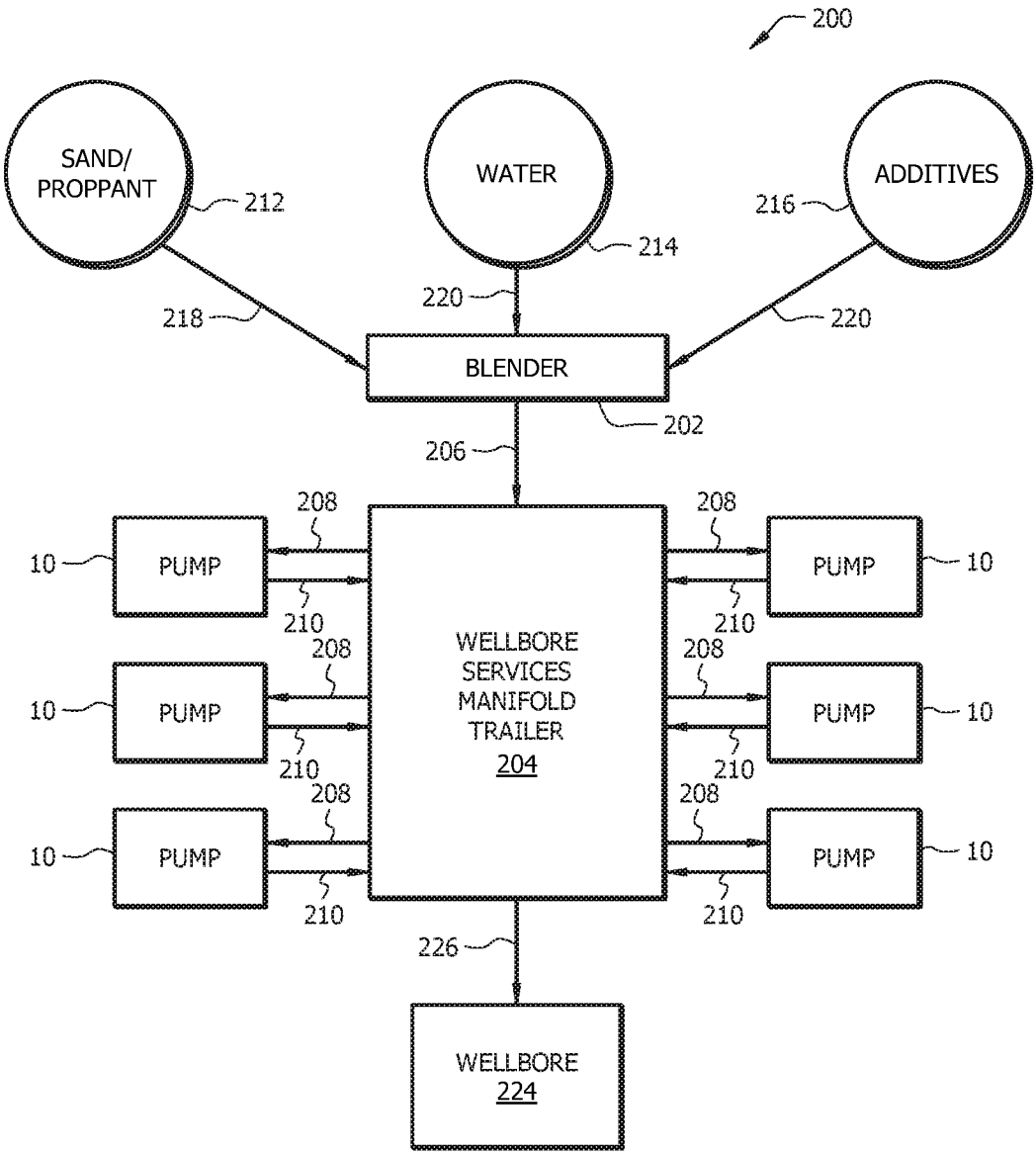
FIG. 7 is a schematic representation of an embodiment of a wellbore servicing system, according to embodiments of this disclosure.

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 7, which is a schematic representation of an embodiment of a wellbore servicing system 200, according to embodiments of this disclosure.

A method of servicing a wellbore 224 according to this disclosure comprises fluidly coupling a pump 10 of this disclosure to a source of a wellbore servicing fluid and to the wellbore, and communicating wellbore servicing fluid into the wellbore 224 via the pump 10. The method can further comprise discontinuing the communicating of the wellbore servicing fluid into the wellbore 224 via the pump 10, subjecting the pump 10 to maintenance to provide a maintained pump 10, wherein subjecting the pump 10 to maintenance comprises removing (via passage through the discharge valve seat 78) the suction valve body 57, the suction valve seat 58, the reciprocating element 18, or a combination thereof from the pump fluid end 22 of the pump 10 via an access port on a side of the discharge valve assembly 72 opposite the suction valve assembly 56, and communicating the or another wellbore servicing fluid into the wellbore via the maintained pump 10. Performing maintenance on the pump 10 can comprise replacing or repairing the suction valve body 57, the suction valve seat 58, the reciprocating element 18, or a combination thereof, or can comprise some other pump maintenance, such as, without limitation, repacking or replacing the (e.g., primary) reciprocating element bore packing 29, wherein the maintenance includes passing the replacement or repaired suction valve body 57, suction valve seat 58, reciprocating element 18, or the combination thereof through the access port and the discharge valve seat 78. The access port is closed prior to resuming operation of the pump 10.

It will be appreciated that the wellbore servicing system 200 disclosed herein can be used for any purpose. In an embodiment, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, sealants, drilling fluids, completion fluids, gelation fluids, polymeric fluids, aqueous fluids, oleaginous fluids, etc.

In an embodiment, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In an embodiment, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In an embodiment, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In an embodiment, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In an embodiment, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In an embodiment, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. in embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In another embodiment, the wellbore servicing systems and methods may be employed in well completion operations such as primary and secondary cementing operation to isolate the subterranean formation from a different portion of the wellbore.

In an embodiment, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In an embodiment, a motor or other power source for a pump may be situated on a common structural support.

In an embodiment, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared onsite (e.g., via the operation of one or more blenders) or, alternatively, transported to the site of the servicing operation.

In an embodiment, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In an alternative embodiment, the reciprocating apparatus may comprise a compressor. In an embodiment, a compressor similar to the pump 10 may comprise at least one each of a cylinder, plunger, connecting rod, crankshaft, and housing, and may be coupled to a motor. In an embodiment, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In an embodiment, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element such as a plunger 18 may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. For instance, sizing of one or more components of the suction valve assembly 56 (e.g., the suction valve body 57 and/or the suction valve seat 58) and/or the reciprocating element 18 and the discharge valve seat 78 of the discharge valve assembly 72 as described herein can reduce a time needed for assembly and/or maintenance, such as replacing one or more suction valve components, replacing a reciprocating element 18, and/or repacking a reciprocating element bore 24, of a pump fluid end 22. The herein disclosed fluid end design comprising a discharge valve a discharge valve assembly comprising a discharge valve seat and a discharge valve body, and a suction valve assembly comprising a suction valve seat and a suction valve body; wherein an inside diameter of the discharge valve seat is greater than an outside diameter of the suction valve body, the suction valve seat, a reciprocating element, or a combination thereof, may reduce maintenance time by at least 10, 20, 30, 40, or 50% relative to a pump fluid end in which an inside diameter of the discharge valve seat is not greater than an outside diameter of the suction valve body, the suction valve seat, a reciprocating element, or the combination thereof. The herein disclosed pump fluid end 22 design provides easy access via an access port (e.g., a front access port such as 30A and/or a top access port such as 30B) located on a side of the discharge valve assembly 72 opposite the suction valve assembly 56, whereby the suction valve body 57, the suction valve seat 58, the reciprocating element 18, or a combination thereof can be removed from the pump fluid end 22 via passage through the discharge valve seat 78 and the access port. A reduction in pump fluid end 22 maintenance and/or assembly time reduces exposure of workers performing the maintenance and non-productive time on location.

ADDITIONAL DISCLOSURE

The following are non-limiting, specific embodiments in accordance with the present disclosure:

Embodiment A: A pump fluid end comprising: a discharge valve assembly comprising a discharge valve seat and a discharge valve body; a suction valve assembly comprising a suction valve seat and a suction valve body; and a reciprocating element, wherein an inside diameter of the discharge valve seat is greater than an outside diameter of the suction valve body, the suction valve seat, the reciprocating element, or a combination thereof.

Embodiment B: The pump fluid end of Embodiment A, wherein the inside diameter of the discharge valve seat is greater than the outside diameter of the suction valve body.

Embodiment C: The pump fluid end of Embodiment A or Embodiment B, wherein the inside diameter of the discharge valve seat is greater than the outside diameter of the suction valve body and the suction valve seat.

Embodiment D: The pump fluid end of any of the prior Embodiments, wherein the inside diameter of the discharge valve seat is greater than the outside diameter of the suction valve body, the suction valve seat, and the reciprocating element.

Embodiment E: The pump fluid end of any of the prior Embodiments, further comprising an access port on a side of the discharge valve assembly opposite the suction valve assembly whereby the suction valve body, the suction valve seat, the reciprocating element, or a combination thereof can be removed from the pump fluid end via passage through the discharge valve seat and the access port.

Embodiment F: The pump fluid end of any of the prior Embodiments, wherein the pump fluid end is a cross-bore pump fluid end.

Embodiment G: The pump fluid end of Embodiment F, wherein the inside diameter of the discharge valve seat is greater than the outside diameter of the suction valve body, the suction valve seat, or a combination thereof.

Embodiment H: The pump fluid end of Embodiment F, wherein the discharge valve assembly is positioned above the suction valve assembly, and further comprising an access port above the discharge valve assembly, whereby the suction valve body, the suction valve seat, or a combination thereof can be removed from the pump fluid end via passage through the discharge valve seat and the access port.

Embodiment I: The pump fluid end of any of Embodiments A through Embodiment E, wherein the pump fluid end is a concentric bore pump fluid end.

Embodiment J: The pump fluid end of Embodiment I, further comprising an access port on a side of the discharge valve assembly opposite the suction valve assembly, whereby the suction valve body, the suction valve seat, the reciprocating element, or a combination thereof can be removed from the pump fluid end via passage through the discharge valve seat and the access port.

Embodiment K: A pump comprising: the pump fluid end of any of the prior Embodiments; and a power end, wherein the power end is operable to reciprocate the reciprocating element within a reciprocating element bore of the pump fluid end.

Embodiment L: A method of servicing the pump of Embodiment K, the method comprising: removing the suction valve body, the suction valve seat, the reciprocating element, or a combination thereof from the pump fluid end via an access port on a side of the discharge valve assembly opposite the suction valve assembly; and inserting a replacement or repaired suction valve body, suction valve seat, reciprocating element, or a combination thereof into the pump fluid end via the access port by passing the replacement or repaired suction valve body, suction valve seat, reciprocating element, or the combination thereof through the discharge valve seat and the access port.

Embodiment M: The method of embodiment L, wherein the access port is located on a front of the pump.

Embodiment N: The method of Embodiment L, wherein the access port is located on a top of the pump.

Embodiment O: The method of any of Embodiment L through Embodiment N, wherein the pump fluid end is a cross-bore pump fluid end, and wherein the access port is located on the top of the pump fluid end.

Embodiment P: The method of Embodiment L, wherein the pump fluid end is a concentric bore pump fluid end, and wherein the access port is located on the front of the pump fluid end.

Embodiment Q: A method of servicing a wellbore, the method comprising: fluidly coupling a pump to a source of a wellbore servicing fluid and to the wellbore, wherein the pump comprises: a pump fluid end and a pump power end, wherein the pump fluid end comprises: a discharge valve assembly comprising a discharge valve seat and a discharge valve body; a suction valve assembly comprising a suction valve seat and a suction valve body; and a reciprocating element, wherein an inside diameter of the discharge valve seat is greater than an outside diameter of the suction valve body, the suction valve seat, the reciprocating element, or a combination thereof, and wherein the pump power end is operable to reciprocate the reciprocating element within a reciprocating element bore of the pump fluid end; and communicating wellbore servicing fluid into the wellbore via the pump.

Embodiment R: The method of Embodiment Q, further comprising: discontinuing the communicating of the wellbore servicing fluid into the wellbore via the pump; subjecting the pump to maintenance to provide a maintained pump, wherein subjecting the pump to maintenance comprises removing the suction valve body, the suction valve seat, the reciprocating element, or a combination thereof from the pump fluid end of the pump via an access port on a side of the discharge valve assembly opposite the suction valve assembly; and communicating the or another wellbore servicing fluid into the wellbore via the maintained pump Embodiment S: The method of Embodiment Q or Embodiment R, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

Embodiment T: The method of Embodiment Q or Embodiment R, wherein the pump or the maintained pump operates during the pumping of the wellbore servicing fluid or the another wellbore servicing fluid at a pressure of greater than or equal to about 3,000 psi, 5,000 psi, 10,000 psi, 20,000 psi, 30,000 psi, 40,000 psi, or 50,000 psi.

Embodiment U: The method of Embodiment Q or Embodiment R, wherein the pump or the maintained pump operates during the pumping of the wellbore servicing fluid or the another wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Embodiment V: A method of servicing a pump, the method comprising: removing a suction valve body, a suction valve seat, a reciprocating element, or a combination thereof from the pump via a discharge valve seat.

Embodiment W: The method of Embodiment V, further comprising: inserting a replacement or repaired suction valve body, suction valve seat, reciprocating element, or a combination thereof into the pump via the access port by passing the replacement or repaired suction valve body, suction valve seat, reciprocating element, or the combination thereof through the discharge valve seat.

Embodiment X: The method of Embodiment V or Embodiment W, wherein removing the suction valve body, the suction valve seat, the reciprocating element, or the combination thereof from the pump via the discharge valve seat comprises removing the suction valve body, the suction valve seat, the reciprocating element, or the combination thereof from the pump via an access port located on a side of the discharge valve seat opposite the suction valve body, the suction valve seat, the reciprocating element, or the combination thereof.

Embodiment Y: The method of Embodiment X, wherein the access port is located on a front or a top of the pump.

Embodiment Z: The method of any of Embodiment V through Embodiment Y, wherein the pump comprises a cross-bore pump fluid end.

Embodiment ZZ: The method of any of Embodiment V through Embodiment Y, wherein the pump comprises a concentric bore pump fluid end.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A pump fluid end comprising:

at least one pump chamber, wherein each pump chamber further comprises:

a discharge valve assembly comprising a discharge valve seat and a discharge valve body;

a single suction valve assembly comprising a suction valve seat and a suction valve body;

a reciprocating element; and an access port on a side of the discharge valve assembly opposite the suction valve assembly, wherein the discharge valve assembly and the suction valve assembly are coaxially aligned along a central axis thereof, wherein the discharge valve seat has an inside diameter across a radially innermost surface thereof, wherein the suction valve body has an outside diameter across a radially outermost surface thereof, wherein the suction valve seat has an outside diameter across a radially outermost surface thereof, wherein a minimum of the inside diameter of the discharge valve seat along a length of the discharge valve seat along the central axis is greater than: (a) a maximum of the outside diameter of the suction valve body along a length of the suction valve body along the central axis, (b) a maximum of the outside diameter of the suction valve seat along a length of the suction valve seat along the central axis, (c) a maximum of an outside diameter of the reciprocating element along a length of the reciprocating element along the central axis; or (d) a combination thereof, and wherein the suction valve body, the suction valve seat, the reciprocating element, or a combination thereof is removable from the pump fluid end via passage through the discharge valve seat and the access port.

2. The pump fluid end of claim 1, wherein the minimum inside diameter of the discharge valve seat is greater than the maximum outside diameter of the suction valve body.

3. The pump fluid end of claim 1 comprising: (a), wherein the minimum inside diameter of the discharge valve seat is greater than the maximum outside diameter of the suction valve body, and (b), wherein the minimum inside diameter of the discharge valve seat is greater than the maximum outside diameter of the suction valve seat.

4. The pump fluid end of claim 1 comprising: (a), wherein the minimum inside diameter of the discharge valve seat is greater than the maximum outside diameter of the suction valve body, (b), wherein the minimum inside diameter of the discharge valve seat is greater than the maximum outside diameter of the suction valve seat, and (c), wherein the minimum inside diameter of the discharge valve seat is greater than the maximum outside diameter of the reciprocating element.

5. The pump fluid end of claim 1, wherein the pump fluid end is a cross-bore pump fluid end.

6. The pump fluid end of claim 5 comprising: (a), wherein the minimum inside diameter of the discharge valve seat is greater than the maximum outside diameter of the suction valve body, or (b), wherein the minimum inside diameter of the discharge valve seat is greater than the maximum outside diameter of the suction valve seat; or both (a), wherein the minimum inside diameter of the discharge valve seat is greater than the maximum outside diameter of the suction valve body, and (b), wherein the minimum inside diameter of the discharge valve seat is greater than the maximum outside diameter of the suction valve seat.

7. The pump fluid end of claim 5, wherein the discharge valve assembly is positioned above the suction valve assembly, and further comprising an access port above the discharge valve assembly, whereby the suction valve body, the suction valve seat, or both the suction valve body and the suction valve seat are removable from the pump fluid end via the discharge valve seat and the access port.

8. The pump fluid end of claim 1, wherein the pump fluid end is a concentric bore pump fluid end.

9. A pump comprising:

the pump fluid end of claim 1; and a power end, wherein the power end is operable to reciprocate the reciprocating element within a reciprocating element bore of the pump fluid end.

10. A method of servicing the pump of claim 9, the method comprising:

removing the suction valve body, the suction valve seat, the reciprocating element, or the combination thereof from the pump fluid end via the access port on the side of the discharge valve assembly opposite the suction valve assembly; and inserting a replacement or repaired suction valve body, suction valve seat, reciprocating element, or the combination thereof into the pump fluid end via the access port by passing the replacement or repaired suction valve body, the suction valve seat, the reciprocating element, or the combination thereof through the discharge valve seat and the access port.

11. The method of claim 10, wherein the access port is located on a front of the pump.

12. The method of claim 11, wherein the access port is located on a top of the pump.

13. The method of claim 10, wherein the pump fluid end is a cross-bore pump fluid end, and wherein the access port is located on a top of the pump fluid end, or wherein the pump fluid end is a concentric bore pump fluid end, and wherein the access port is located on the front of the pump fluid end.

14. A method of servicing a wellbore, the method comprising:

fluidly coupling a pump to a source of a wellbore servicing fluid and to the wellbore, wherein the pump comprises:

a pump fluid end and a pump power end, wherein the pump fluid end comprises at least one pump chamber, wherein each pump chamber further comprises: a discharge valve assembly comprising a discharge valve seat and a discharge valve body; a single suction valve assembly comprising a suction valve seat and a suction valve body; a reciprocating element; and an access port on a side of the discharge valve assembly opposite the suction valve assembly, wherein the discharge valve assembly and the suction valve assembly are coaxially aligned along a central axis thereof, wherein the discharge valve seat has an inside diameter across a radially innermost surface thereof, wherein the suction valve body has an outside diameter across a radially outermost surface thereof, wherein the suction valve seat has an outside diameter across a radially outermost surface thereof, wherein a minimum of the inside diameter of the discharge valve seat along a length of the discharge valve seat along the central axis is greater than: (a) a maximum of the outside diameter of the suction valve body along a length of the suction valve body along the central axis, (b) a maximum of the outside diameter of the suction valve seat along a length of the suction valve seat along the central axis, (c) a maximum of an outside diameter of the reciprocating element along a length of the reciprocating element along the central axis or (d) a combination thereof, and wherein the pump power end is operable to reciprocate the reciprocating element within a reciprocating element bore of the pump fluid end, and wherein the suction valve body, the suction valve seat, the reciprocating element, or a combination thereof is removable from the pump fluid end via passage through the discharge valve seat and the access port; and communicating the wellbore servicing fluid into the wellbore via the pump.

15. The method of claim 14 further comprising:

discontinuing the communicating of the wellbore servicing fluid into the wellbore via the pump;

subjecting the pump to maintenance to provide a maintained pump, wherein subjecting the pump to maintenance comprises removing the suction valve body, the suction valve seat, the reciprocating element, or the combination thereof from the pump fluid end of the pump via the access port on a side of the discharge valve assembly opposite the suction valve assembly; and communicating the wellbore servicing fluid or another wellbore servicing fluid into the wellbore via the maintained pump.

16. The method of claim 15, wherein the wellbore servicing fluid, the another wellbore servicing fluid, or both the wellbore servicing fluid and the another wellbore servicing fluid comprise a fracturing fluid, a cementitious fluid, a remedial fluid, a perforating fluid, a sealant, a drilling fluid, a spacer fluid, a completion fluid, a gravel pack fluid, a gelation fluid, a polymeric fluid, an aqueous fluid, an oleaginous fluid, or a combination thereof.

17. The method of claim 15, wherein the pump or the maintained pump operates during the pumping of the wellbore servicing fluid or the another wellbore servicing fluid at a pressure in a range of from 3,000 psi to 50,000 psi.

18. The method of claim 17, wherein the pump or the maintained pump operates during the pumping of the wellbore servicing fluid or the another wellbore servicing fluid at a volumetric flow rate of greater than or equal to 3 barrels per minute (BPM), or in a range of from about 3 to 20 BPM.

19. The method of claim 10, wherein the pump comprises a cross-bore pump fluid end.

20. The pump fluid end of claim 5, comprising both (a), wherein the minimum inside diameter of the discharge valve seat is greater than the maximum outside diameter of the suction valve body, and (b), wherein the minimum inside diameter of the discharge valve seat is greater than the maximum outside diameter of the suction valve seat.

* * * * *